US010494146B2

(12) United States Patent
Verma

(10) Patent No.: US 10,494,146 B2
(45) Date of Patent: Dec. 3, 2019

(54) FLIPSNAP HOLD OPEN MECHANISM FOR FLEXIBLE PACKAGING

(71) Applicant: Vishaal B. Verma, Evanston, IL (US)

(72) Inventor: Vishaal B. Verma, Evanston, IL (US)

( * ) Notice: Subject to any disclaimer, the term of this patent is extended or adjusted under 35 U.S.C. 154(b) by 331 days.

(21) Appl. No.: 13/786,068

(22) Filed: Mar. 5, 2013

(65) Prior Publication Data

US 2013/0248541 A1 Sep. 26, 2013

Related U.S. Application Data

(60) Provisional application No. 61/634,616, filed on Mar. 5, 2012.

(51) Int. Cl.

| | |
|---|---|
| ***B65D 33/00*** | (2006.01) |
| *B65B 9/10* | (2006.01) |
| *B65B 61/18* | (2006.01) |

(52) U.S. Cl.

CPC ..... *B65D 33/00* (2013.01); *B65D 33/007* (2013.01); *B65B 9/10* (2013.01); *B65B 61/188* (2013.01); *Y10T 29/49826* (2015.01)

(58) Field of Classification Search

CPC ..... B65D 33/007; B65D 33/16; B65D 33/30; B65D 33/1658; B65D 33/02;

(Continued)

(56) References Cited

U.S. PATENT DOCUMENTS

| | | | |
|---|---|---|---|
| 199,507 | A | 1/1878 | Brubaker |
| 1,463,113 | A | 7/1923 | Bibb |

(Continued)

FOREIGN PATENT DOCUMENTS

| | | | |
|---|---|---|---|
| EP | 2112085 | A1 | 10/2009 |
| GB | 189726598 | A | 11/1898 |

(Continued)

OTHER PUBLICATIONS

Impact Advanced Concepts, "Snap Span" earliest available publication Apr. 8, 2012 at https://web.archive.org/web/20120408231153/http://www.snap-span.com/ downloaded Apr. 29, 2014 (2 pages).

(Continued)

*Primary Examiner* — Jes F Pascua

*Assistant Examiner* — Matthew T Theis

(74) *Attorney, Agent, or Firm* — McLane Middleton, Professional Association

(57) ABSTRACT

One embodiment relates to a hold open mechanism including first and second flat, strip-like members. Each of the first and second flat, strip-like members are comprised of a flexible material and have two opposing ends and an edge including two wide sections, one of each of which is located at the opposing ends of the members; a narrow section having a width less than the two wide sections and extending between and coupling the two wide sections; at least one mounting tab extending along at least a portion of the edge and connected thereto via a first pivot member having an orientation parallel with the length of the members. The first and second flat, strip-like members act as a flip tab providing a surface area for a user to access and manipulate between an upwards and downwards configuration relative to the orientation of the mechanism.

15 Claims, 8 Drawing Sheets

(58) Field of Classification Search
CPC .. B65D 67/1255; B65D 61/188; B65D 33/00; B65D 9/10; B65B 67/1255; B65B 61/188; B65F 1/0006; Y10T 29/49826
USPC ..... 383/34, 33, 34.1, 97, 61.2, 63, 46; 493/287; 220/694; 29/428
See application file for complete search history.

(56) References Cited

U.S. PATENT DOCUMENTS

| | | | | |
|---|---|---|---|---|
| 1,887,940 | A | 11/1932 | Marinsky | |
| 2,008,314 | A | 7/1935 | Russell | |
| 2,040,271 | A | 5/1936 | Rozenweig | |
| 2,074,843 | A | 5/1937 | Hiering | |
| 2,142,904 | A | 1/1939 | Lamarthe | |
| 2,150,627 | A | 3/1939 | Lieber | |
| 2,693,212 | A | 11/1954 | Guichard | |
| 3,313,469 | A | 4/1967 | Drozda | |
| 4,069,994 | A | 1/1978 | Wharmby | |
| 4,486,923 | A | 12/1984 | Briggs | |
| 4,664,348 | A | 5/1987 | Corsaut, III et al. | |
| 4,753,367 | A | 6/1988 | Miller et al. | |
| 4,753,489 | A | 6/1988 | Mochizuki | |
| 4,758,099 | A | 7/1988 | Branson | |
| 4,815,866 | A | 3/1989 | Martone | |
| 5,035,518 | A | 7/1991 | McClintock | |
| 5,037,138 | A | 8/1991 | McClintock et al. | |
| 5,044,774 | A * | 9/1991 | Bullard et al. | 383/34.1 |
| 5,082,219 | A | 1/1992 | Blair | |
| 5,183,227 | A | 2/1993 | Wilhite | |
| 5,184,896 | A | 2/1993 | Hammond et al. | |
| 5,524,990 | A * | 6/1996 | Buck | 383/34 |
| 5,609,419 | A | 3/1997 | Byers, Jr. | |
| 5,676,306 | A | 10/1997 | Lankin et al. | |
| 5,716,138 | A * | 2/1998 | Southwell | B65D 33/02 383/104 |
| 6,022,144 | A | 2/2000 | Hausslein | |
| 6,149,304 | A | 11/2000 | Hamilton et al. | |
| 6,164,821 | A | 12/2000 | Randall | |
| 6,231,235 | B1 | 5/2001 | Galomb et al. | |
| 6,234,674 | B1 | 5/2001 | Byers, Jr. | |
| 6,234,676 | B1 | 5/2001 | Galomb et al. | |
| 6,273,608 | B1 | 8/2001 | Ward et al. | |
| 6,345,911 | B1 * | 2/2002 | Young | A61J 19/00 383/104 |
| 6,508,587 | B1 | 1/2003 | Byers, Jr. | |
| 6,572,267 | B1 | 6/2003 | Forman | |
| 6,578,585 | B1 | 6/2003 | Stachowski et al. | |
| 6,678,923 | B2 | 1/2004 | Goldberg | |
| 6,899,460 | B2 | 5/2005 | Turvey et al. | |
| 6,904,647 | B2 * | 6/2005 | Byers, Jr. | 24/30.5 R |
| 7,681,784 | B2 | 3/2010 | Lang | |
| 8,333,351 | B2 | 12/2012 | Kramer | |
| 2003/0033694 | A1 | 2/2003 | Cisek | |
| 2004/0195467 | A1 | 10/2004 | Passage | |
| 2004/0208400 | A1 | 10/2004 | Linneweil | |
| 2005/0137073 | A1 * | 6/2005 | Weaver | 493/394 |
| 2005/0281487 | A1 | 12/2005 | Pawlowski | |
| 2006/0010659 | A1 | 1/2006 | Penn | |
| 2006/0280386 | A1 | 12/2006 | Bublitz | |
| 2008/0019618 | A1 | 1/2008 | Dayton et al. | |
| 2008/0044110 | A1 * | 2/2008 | Garger | B65D 31/10 383/5 |
| 2009/0046955 | A1 | 2/2009 | Schember et al. | |
| 2011/0188785 | A1 | 8/2011 | Turvey et al. | |
| 2011/0226914 | A1 | 9/2011 | Fleming | |
| 2012/0138623 | A1 | 6/2012 | Verma | |
| 2013/0064480 | A1 | 3/2013 | Verma | |
| 2014/0014789 | A1 | 1/2014 | Verma | |
| 2014/0259868 | A1 | 4/2014 | Verma | |
| 2014/0314342 | A1 | 10/2014 | Verma | |

FOREIGN PATENT DOCUMENTS

| | | | |
|---|---|---|---|
| JP | 51-017122 | U | 2/1976 |
| JP | 2000-085905 | A | 3/2000 |
| JP | 2003-072779 | A | 3/2003 |
| WO | 99/00312 | A1 | 1/1999 |

OTHER PUBLICATIONS

Jokari Baggy Rack, "Baggy Pack Pro" earliest available publication Nov. 15, 2012 at https://web.archive.org/web/20121115010901/http://www.jokari.com/products/G_169606.html downloaded Apr. 28, 2014 (1 page).
International Search Report and Written Opinion of the International Searching Authority, received for International Patent Application No. PCT/US2014/035154, dated Aug. 29, 2014 (12 pages).
International Search Report and Written Opinion of the International Searching Authority, received for International Patent Application No. PCT/US2012/068314, dated Mar. 14, 2013 (6 pages).
International Search Report and Written Opinion of the International Searching Authority, received for International Patent Application No. PCT/US2011/062840, dated Apr. 23, 2012 (6 pages).
U.S. Patent and Trademark Office Non-final Office Action, received for U.S. Appl. No. 12/958,217, dated Nov. 6, 2012 (7 pages).
U.S. Patent and Trademark Office Final Office Action, received for U.S. Appl. No. 12/958,217, dated Apr. 12, 2013 (10 pages).
U.S. Patent and Trademark Office Non-final Office Action, received for U.S. Appl. No. 13/485,773, dated Nov. 3, 2014 (12 pages).

* cited by examiner

SECTION B-B

DETAIL A

DETAIL C

FLIPSNAP HOLD OPEN MECHANISM FOR FLEXIBLE PACKAGING

CLAIM FOR PRIORITY

This application claims priority from U.S. Provisional Application Ser. No. 61/634,616 filed Mar. 5, 2012, the complete subject matter of which is incorporated herein by reference in its entirety.

FIELD OF THE INVENTION

The invention relates to a closing mechanism. More particularly, embodiments relate to a hold open mechanism used with a package, bag, or container and a method of accessing a package, bag, or container having a hold open mechanism.

BACKGROUND OF THE INVENTION

Pliable containers are widely used to store both edible and non-edible products. For example, snack items, such as various types of chips and cereals, are typically packaged in pliable containers. These containers are generally sealed at both ends for initial packaging purposes and then one end is opened to access the product.

Current flexible packaging formats often include zip type closures for creating a reusable air tight seal at the open end of the package or container. Although these configurations often make opening and closing the package simple and convenient, the flexible nature of both the package and zip type closure make it difficult to maintain the package in an open configuration such that the side walls of the package are widely separated making it easy to access withheld contents. It is considered advantageous to enhance the accessibility to the interior of a container when the container is opened. More specifically, when the container is opened, it is desirable to maintain the side walls of the container in an open configuration, at least at the open end of the container, to permit easy access to the contents.

Embodiments may be used in conjunction with any variety of closure mechanisms and packaging formats including sachet and stand up style pouches for example. Embodiments are comprised of a relatively thin ring shaped structure made from any flexible material (polypropylene, or polyethylene for example) including flat, strip-like members. Each member includes a mounting tab coupled to the member via a first pivot member which allows the member to rotate from a first upwards configuration to a second downwards configuration. The members are coupled to each other via a second pivot member which is limited in rotation. When in the first upwards configuration, the second pivot members are free to rotate and mate the inner surface of the members forming a seal. In the second downwards configuration, the second pivot members are limited in rotation holding the wide section of the members forming a ring like shape at the open end of the package allowing open access to the withheld contents. The mechanism can be manufactured as a fitment where each unit is applied to a pouch as part of an assembly process or as a tape where the mechanisms are applied in conjunction with HFFS or VFFS machinery.

For the foregoing reasons, there is a need for a simple, hold open mechanism ath that can both improve resealing functionality when in the closed or sealed configuration and enhance accessibility to withheld contents when in the open configuration.

SUMMARY OF THE INVENTION

One embodiment relates to a hold open mechanism including a first flat, strip-like member comprised of a flexible material and having two opposing ends and an edge, the first flat, strip-like member acting as a flip tab providing a surface area for a user to access and manipulate between an upwards and downwards configuration relative to an orientation of the mechanism comprising: two wide sections, one of each of which is located at the opposing ends of the first flat, strip-like member; a narrow section having a width less than the two wide sections and extending between and coupling the two wide sections; at least one mounting tab extending along at least a portion of the edge and connected thereto via a first pivot member having an orientation parallel with the length of the first flat, strip-like member, enabling the first flat, strip-like member to pivot between a first upwards configuration to a second downwards configuration. The hold open mechanism further includes a second flat, strip-like member comprised of a flexible material and having two opposing ends and an edge, the second flat, strip-like member acting as a flip tab providing a surface area for a user to access and manipulate between an upwards and downwards configuration relative to the orientation of the mechanism including two wide sections, one of each of which is located at the opposing ends of the first flat, strip-like member; a narrow section having a width less than the two wide sections and extending between and coupling the two wide sections; at least one mounting tab extending along at least a portion of the edge and connected thereto via a first pivot member having an orientation parallel with the length of the second flat, strip-like member, enabling the first flat, strip-like member to pivot between a first upwards configuration to a second downwards configuration; and two second pivot members, one of each of the two second pivot member located at each opposing end of the first and second flat, strip-like members at respective wide sections, having an orientation generally perpendicular to the first pivot member and moveably coupling the first flat, strip-like member to the second flat, strip-like member at their opposing ends.

Another embodiment relates to a hold open mechanism including a first flat, strip-like member comprised of a flexible material and having two opposing ends and an edge, the first flat, strip-like member acting as a flip tab providing a surface area for a user to access and manipulate between an upwards and downwards configuration relative to an orientation of the mechanism including two wide sections, one of each of which is located at the opposing ends of the first flat, strip-like member; a narrow section having a width less than the two wide sections and extending between and coupling the two wide sections; at least one mounting tab extending along at least a portion of the edge and connected thereto via a first pivot member having an orientation parallel with the length of the first flat, strip-like member, enabling the first flat, strip-like member to pivot between a first upwards configuration to a second downwards configuration, the at least one mounting tab further including a mounting area. The hold open mechanism further includes a second flat, strip-like member comprised of a flexible material and having two opposing ends and an edge, the second flat, strip-like member acting as a flip tab providing a surface area for a user to access and manipulate between an upwards and downwards configuration relative to the orientation of the mechanism including two wide sections, one of each of which is located at the opposing ends of the first flat, strip-like member; a narrow section having a width less than the two wide sections and extending between and coupling the two wide sections; at least one mounting tab extending along at least a portion of the edge and connected thereto via a first pivot member having an orientation parallel with the length of the second flat, strip-like member, enabling the first flat, strip-like member to pivot between a first upwards configuration to a second downwards configuration, the at least one mounting tab further including a mounting area; and a first bonding tab located proximate the wide section of the first or second flat, strip-like member, including a surface area for bonding the first flat, strip-like member and the second flat, strip-like member and coupled to the first or second flat, strip-like member; a second pivot member with an orientation generally perpendicular to the first pivot member coupling the first or second flat, strip-like member to the first bonding tab; a second bonding tab located proximate one or more mounting tabs of one of the first or second flat, strip-like member including a surface area for bonding the second bonding tab of the second flat, strip-like member to the mounting tab of the first flat, strip-like member or bonding the second bonding tab of the first flat, strip-like member to the mounting tab of the second flat, strip like member; a third pivot member with an orientation generally perpendicular to the first pivot member coupling the one or more mounting tabs of the first flat, strip-like member to the second bonding tab of the second flat, strip-like member; a slit defined between the wide section and the mounting tab along a portion of the end of each of the first and second flat, strip-like members, separating the first and second bonding tab; the first flat, strip-like member bonded to the second flat, strip-like member via the first and second bonding tab features; where the second bonding tab interferes with the first or second, flat strip like members when the first and second flat, strip-like members are in a downwards configuration, holding the first and second, flat strip like members in a separated configuration relative to one another.

Still another embodiment relates to a container including a package comprising an open end and a closed end; and a hold open mechanism mounted proximate the open end of the package including a first flat, strip-like member comprised of a flexible material and having two opposing ends and an edge, the first flat, strip-like member acting as a flip tab providing a surface area for a user to access and manipulate between an upwards and downwards configuration relative to an orientation of the mechanism including two wide sections, one of each of which is located at the opposing ends of the first flat, strip-like member; a narrow section having a width less than the two wide sections and extending between and coupling the two wide sections; at least one mounting tab extending along at least a portion of the edge and connected thereto via a first pivot member having an orientation parallel with the length of the first flat, strip-like member, enabling the first flat, strip-like member to pivot between a first upwards configuration to a second downwards configuration; a second flat, strip-like member comprised of a flexible material and having two opposing ends and an edge, the second flat, strip-like member acting as a flip tab providing a surface area for a user to access and manipulate between an upwards and downwards configuration relative to the orientation of the mechanism including two wide sections, one of each of which is located at the opposing ends of the first flat, strip-like member; a narrow section having a width less than the two wide sections and extending between and coupling the two wide sections; and at least one mounting tab extending along at least a portion of the edge and connected thereto via a first pivot member having an orientation parallel with the length of the second flat, strip-like member, enabling the first flat, strip-like member to pivot between a first upwards configuration to a second downwards configuration.

Yet another embodiment relates to a method of using the hold open mechanism including opening the hold open mechanism including starting from a closed configuration where first and second flat, strip-like members are mated allowing the closure mechanism to maintain a closed configuration; disengaging a closure mechanism located proximate the hold open mechanism so as to release a seal thus opening a package and separating the side walls of the package; further separating the side walls of the package by applying an inwards pressure relative to the opening of the hold open mechanism at opposing ends of the hold open mechanism, thus moving the hold open mechanism from a first closed configuration to a second open configuration; applying an inwards and downwards pressure to a first and second flat, strip-like members thus rotating the first and second flat, strip-like members about respective first pivot members; moving the first and second flat, strip-like members from a first upwards configuration to a second downwards configuration; maintaining an open and separated position of the first flat, strip-like member maintaining an open and separated position relative to the second flat, strip-like member thus allowing for easy access to a contents of the container. Closing the mechanism includes moving the first and second flat strip-like members in a separated and downwards configuration; applying an inwards and upwards pressure to the first and second flat, strip-like members thus rotating the first and second flat, strip-like members about respective pivot members; returning the first and second flat, strip-like members to a first, upwards configuration and having the ability to rotate freely about respective second pivot members and mate to one another allowing the closure mechanism to be engaged; and engaging the closure mechanism located proximate the hold open mechanism to close the seal thus preserving the withheld contents.

Still one other embodiment relates to a method for manufacturing a hold open mechanism including homogeneously producing the hold open mechanism further includes injection molding both first and second flat, strip-like members as a single component then bonding to flexible package as a fitment.

Still another embodiment relates to a method for manufacturing a hold open mechanism including heterogeneously producing any portion of a first and second flat, strip-like members comprising; and assembling the first and second, flat, strip-like members including bonding the first flat, strip-like member to the second, flat, strip-like member selected from the group comprising adhesive, heat sealing, and ultrasonic welding.

The foregoing and other features and advantages of the invention will become further apparent from the following detailed description of the presently preferred embodiment, read in conjunction with the accompanying drawings. The drawings are not to scale. The detailed description and drawings are merely illustrative of the invention rather than limiting, the scope of the invention being defined by the appended claims and equivalents thereof.

BRIEF DESCRIPTION OF THE DRAWINGS

Throughout the various figures, like reference numbers refer to like elements.

DETAILED DESCRIPTION

Embodiments of the present invention are designed to replace the inconvenient functionality of the conventional zip type closure mechanism. It can be used in any application requiring an instant seal where the user is only required to apply a light pressure to open and close the seal. In at least one embodiment, Current flexible packaging formats often include zip type closures for creating a reusable air tight seal at the open end of the package or container. Although these configurations often make opening and closing the package simple and convenient, the flexible nature of both the package and zip type closure make it difficult to maintain the package in an open configuration where the side walls of the package are widely separated making it easy to access withheld contents. The flip-snap hold open mechanism can be used in conjunction with any variety of closure mechanisms and packaging formats including sachet and stand up style pouches for example. The mechanism is comprised of a relatively thin ring shaped structure made from any flexible material (polypropylene, or polyethylene for example) including a first and second flat, strip-like member. Each member includes a form consisting of two wide sections at either end of the mechanism coupled by a narrow section. The upper portion of each member is coupled to a mounting tab via a first pivot member which allows the upper portion to rotate from a first upwards configuration to a second downwards configuration. The first member is coupled to the second member via a second pivot member which is limited in rotation. When in the first upwards configuration, the second pivot members are free to rotate and mate the inner surface of the first member with that of the second member allowing the closure to form a seal. In the second downwards configuration, the second pivot members are limited in rotation holding the wide section of the first member separated from the wide section of the second member forming a ring like shape at the open end of the package allowing open access to the withheld contents. The mechanism can be manufactured as a fitment where each unit is applied to a pouch as part of an assembly process or as a tape where the mechanisms are applied in conjunction with HFFS or VFFS machinery.

Figure 1:
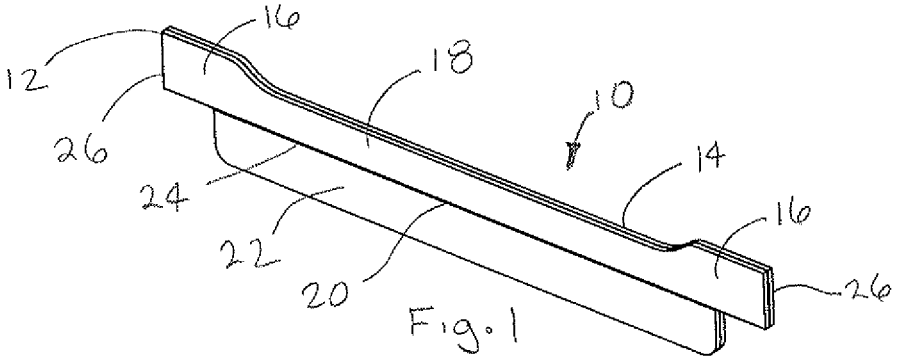
FIG. 1 is an isometric view of a hold open mechanism (used in a fitment process for example) in a closed configuration in accordance with one embodiment.

FIG. 1 is an isometric view of a hold open mechanism (used in a fitment process for example) and generally designated 10 in a closed configuration in accordance with one embodiment. As illustrated in FIG. 1, mechanism 10 includes a first member 12 and second member 14. In at least one embodiment, at least one or both of the first and second flat, strip-like members 12, 14 are flexible or semi-rigid material such as polypropylene, polyethylene, a blend of polypropylene and polyethylene and the like. Each of the first and second members 12, 14 having wide sections 16 located at opposing ends of the first and second members 12, 14 and a narrow section 18 having a width less than the wide sections 18 and extending between and connecting the wide sections 16. Each of the first and second members 12, 14 has an edge 20.

FIG. 1 further illustrates at least one mounting tab 22, but generally two or more mounting tabs 22, extending along at least a portion of the edge 20 having an orientation parallel with the length of the first and second, flat, strip like members 12, 14. Mounting tab 22 is connected to the first and second, flat, strip like members 12, 14 via a first pivot member 24, enabling the first and second, flat strip like member 12, 14 to pivot between a first upwards configuration to a second downwards configuration (best illustrated in FIGS. 2-3).

Two second pivot members 26, one of each of the two second pivot members 26 located at each opposing end of the first and second flat, strip-like members 12, 14 at respective wide sections. The two second pivot members 26 have an orientation generally perpendicular to the first pivot member 24 and moveably coupling the first flat, strip-like member 12 to the second flat, strip-like member 14 at their opposing ends.

Figure 2:
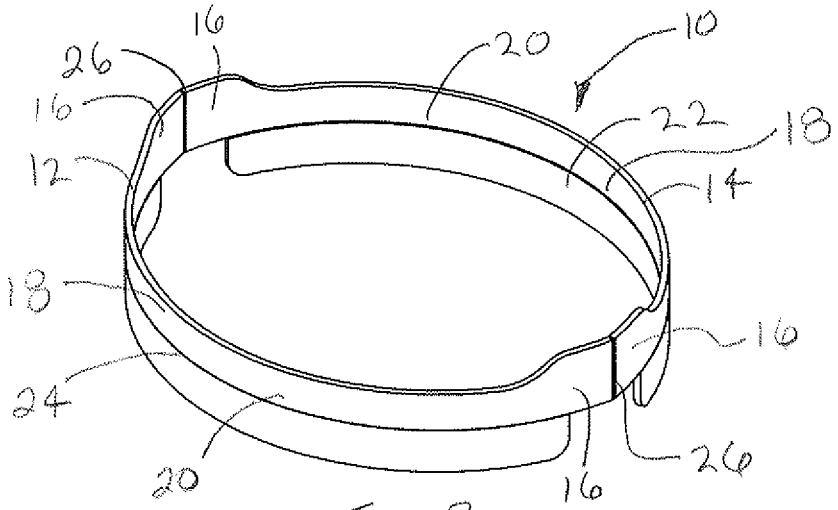
FIG. 2 is an isometric view of the hold open mechanism of FIG. 1 in an open and upwards configuration in accordance with one embodiment.
Figure 3:
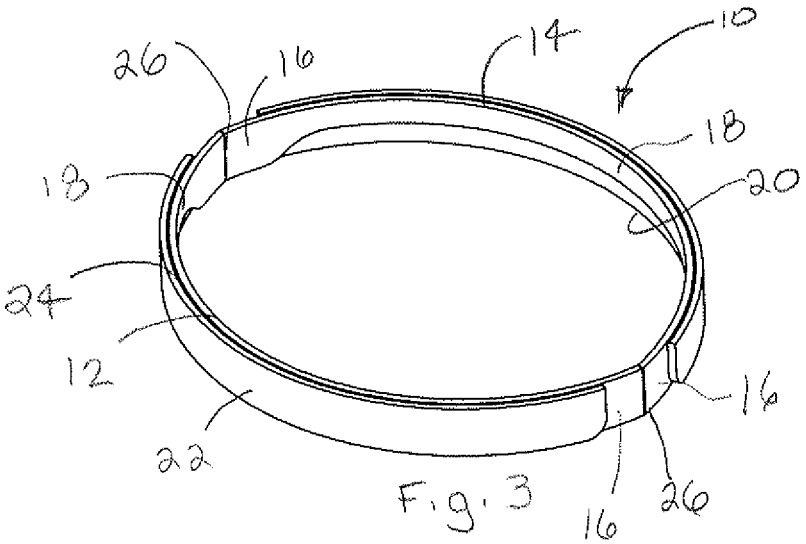
FIG. 3 is an isometric view of the hold open mechanism of FIG. 1 in an open and downwards configuration in accordance with one embodiment.

FIG. 2 depicts an isometric view of the hold open mechanism 10 of FIG. 1 in an open and upwards configuration in accordance with one embodiment, having the first and second flat, strip-like members 12, 14 in an upwards configuration. FIG. 3 is an isometric view of the hold open mechanism 10 of FIG. 1 in an open and downwards configuration in accordance with one embodiment, having the first and second flat, strip-like members 12, 14 in a downwards configuration.

Figure 4A:
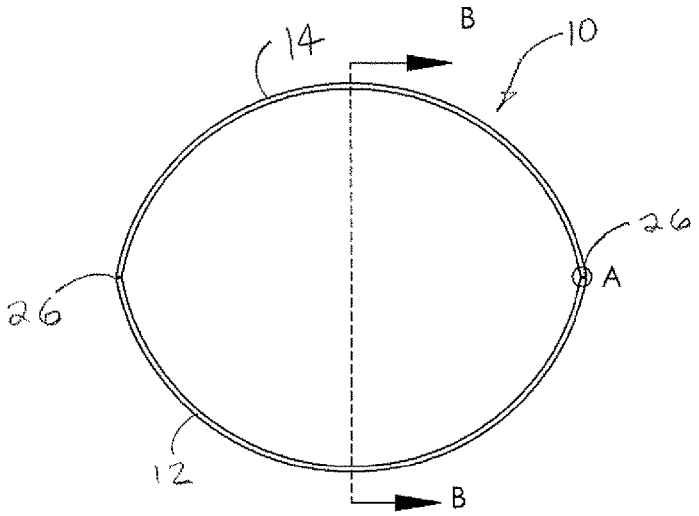
FIG. 4A is a top view of the hold open mechanism of FIG. 1 in an open/upwards configuration in accordance with one embodiment.
Figure 4B:
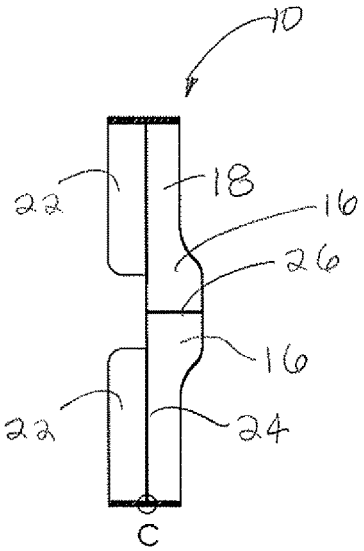
FIG. 4B is a cross-sectional view of the hold open mechanism of FIG. 4A taken along line B-B in accordance with one embodiment.
Figure 4C:
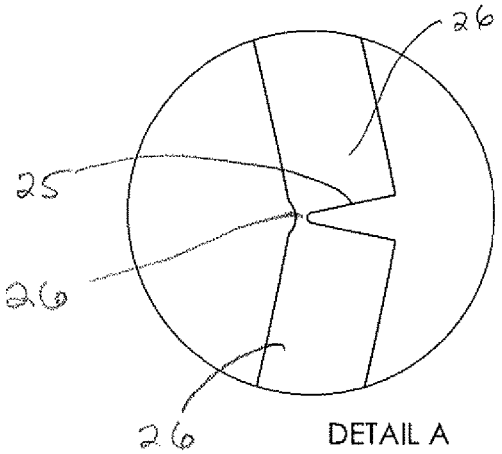
FIG. 4C is an enlarged view of detail A of FIG. 4A in accordance with one embodiment.
Figure 4D:
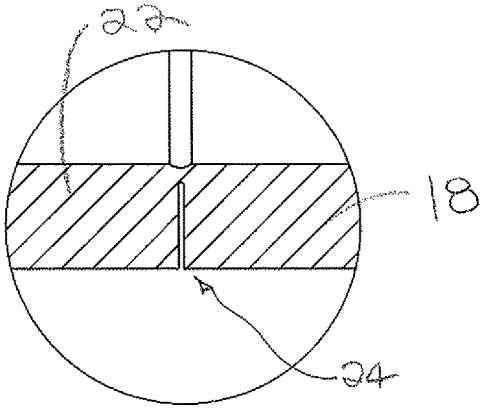
FIG. 4D is an enlarged view of detail C of FIG. 4B in accordance with one embodiment.

FIG. 4A depicts a top view of the hold open mechanism 10 of FIG. 1 in open/upwards configuration in accordance with one embodiment. FIG. 4B is a cross-sectional view of the hold open mechanism 10 of FIG. 4A taken along line B-B in accordance with one embodiment. FIG. 4C is an enlarged view of detail A of the hold open mechanism 10 of FIG. 4A in accordance with one embodiment. FIG. 4C illustrates the second pivot member 26 which in the illustrated embodiment is a living hinge where a thin portion of the hinge is located proximate an inner surface of the hold open mechanism 10 and the indentation separation is located proximate the outer surface of the hold open mechanism 10. FIG. 4D is an enlarged view of detail C of the hold open mechanism 10 of FIG. 4B in accordance with one embodiment. The first pivot member 24 includes indentation walls or shoulders 25 limiting the rotation of the first and second, flat strip-like members 12, 14 about the first pivot member 24 so that the ends of the first and second, flat strip-like members 12, 14 cannot rotate past 180 degrees of separation when the first and second, flat strip-like members 12, 14 are in a first upwards configuration. The first pivot member 24 engage when the second, flat strip-like member 14 is in a downwards configuration, holding the first and second, flat strip-like members 12, 14 in a separated or held open configuration relative to one another.

Figure 5:
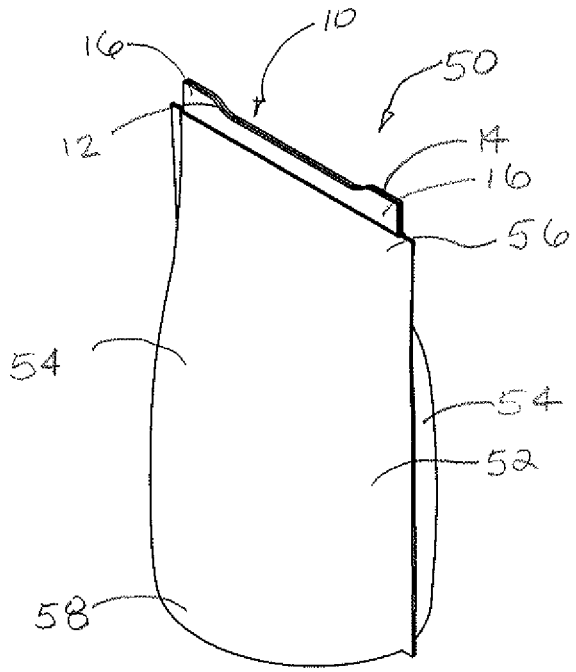
FIG. 5 is a side view of the hold open mechanism of FIG. 1 in a closed configuration mounted to a flexible container (a stand up pouch) in accordance with one embodiment.
Figure 6:
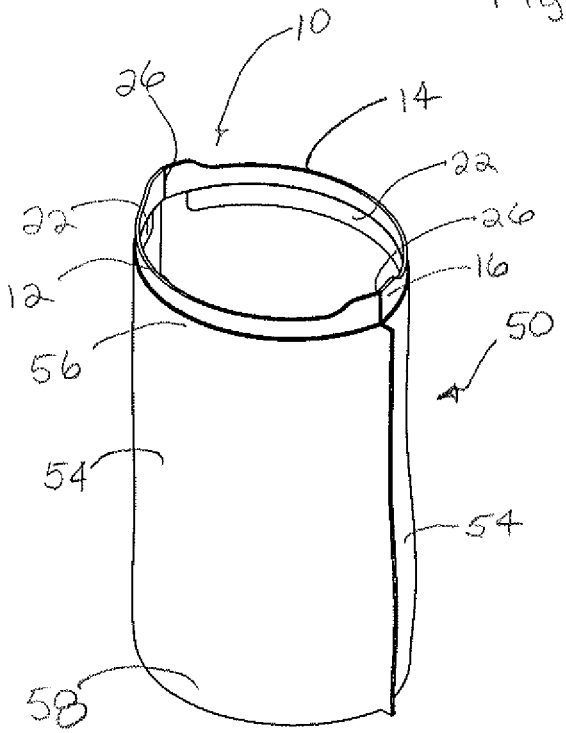
FIG. 6 is a side view of the hold open mechanism of FIG. 5 in an open/first upwards configuration mounted to the flexible structure in accordance with one embodiment.
Figure 7:
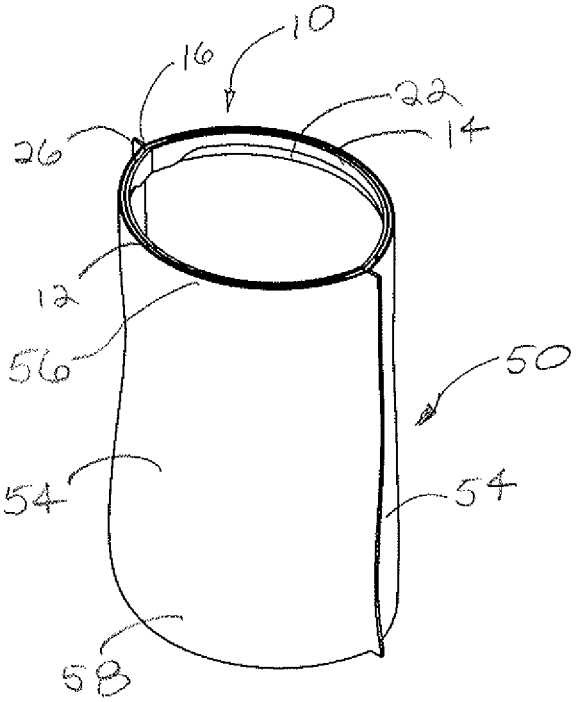
FIG. 7 is side view of the hold open mechanism of FIG. 5 in an open/second downwards configuration mounted to the flexible structure in accordance with one embodiment.

FIG. 5-7 depict side views of a container 50 including the hold open mechanism 10 of FIG. 1 coupled or mounted to a flexible package 52 (a stand up pouch for example) in accordance with one embodiment. FIG. 5 illustrates that package 52 has an open end 56, opposing closed end 58 and opposing package side walls 54 extending there between. In the illustrated embodiment at least one of the mounting tabs 22 includes a surface area for mounting the hold open mechanism 10 to an internal surface the package side walls 54 of flexible package 50 (best viewed in FIGS. 6-7) using a mounting method such as a fitment feed (using adhesive bonding, heat sealing, ultrasonic welding, or blend of adhesive bonding, heat sealing and ultrasonic welding), tape feed and the like.

Figure 8:
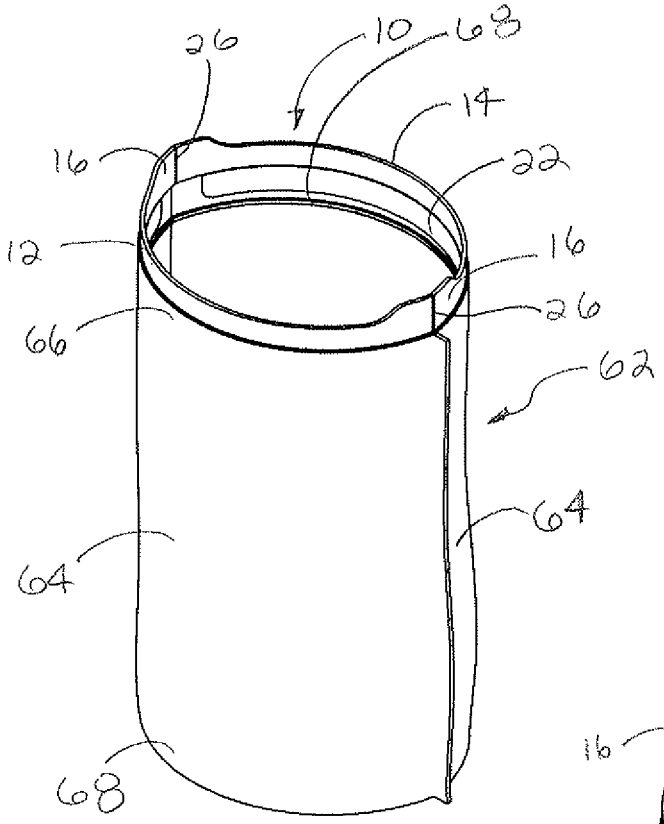
FIG. 8 is a side view of a hold open mechanism in an open configuration mounted to the flexile structure proximate a zip-type closure also mounted to the flexible structure in accordance with one embodiment.
Figure 9:
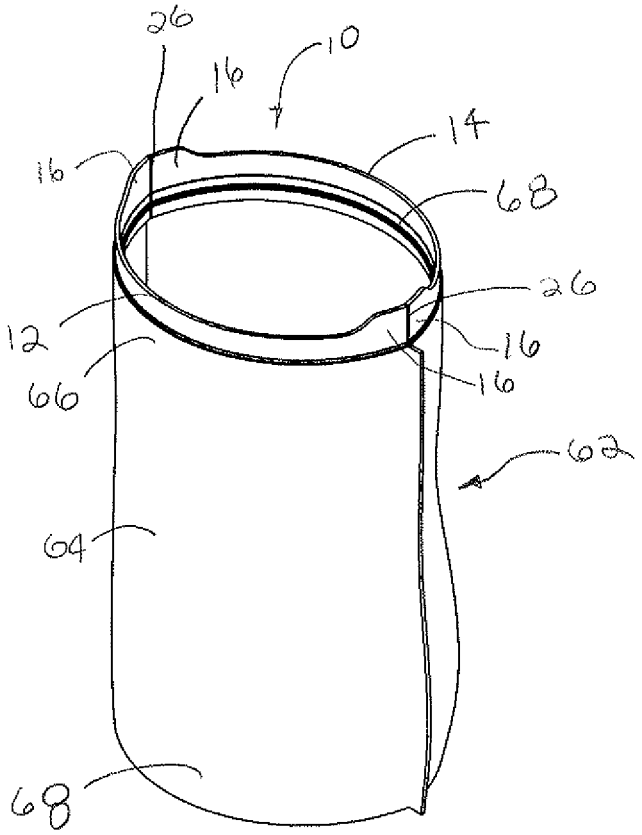
FIG. 9 is side view of the hold open mechanism of FIG. 8 in an open configuration mounted to the flexile structure proximate a zip-type closure mounted to the internal surface of the hold open mechanism in accordance with one embodiment.

FIGS. 8-9 depict side views of a container 60 including the hold open mechanism 10 of FIG. 1 coupled or mounted to a flexible package 62 (a stand up pouch for example) in accordance with one embodiment. FIGS. 8-9 illustrate that package 62 has an open end 66, opposing closed end 68 and opposing package side walls 64 extending there between. In the embodiments illustrated in FIGS. 8-9, at least one of the mounting tabs 22 includes a surface area for mounting the hold open mechanism 10 to an internal surface the package side walls 64 of flexible package 60 (best viewed in FIGS. 8-9) using any known mounting method including a fitment feed (using adhesive bonding, heat sealing, ultrasonic welding, or blend of adhesive bonding, heat sealing and ultrasonic welding), tape feed and the like.

FIGS. 8 and 9 further depict the container 60 include a closure mechanism 68 in conjunction with, and proximate to the hold open mechanism 10. In one embodiment, closure mechanism 68 includes a reusable closure mechanism, a non-reusable closure, a zip-type closure mechanism, an adhesive and the like.

Figure 10:
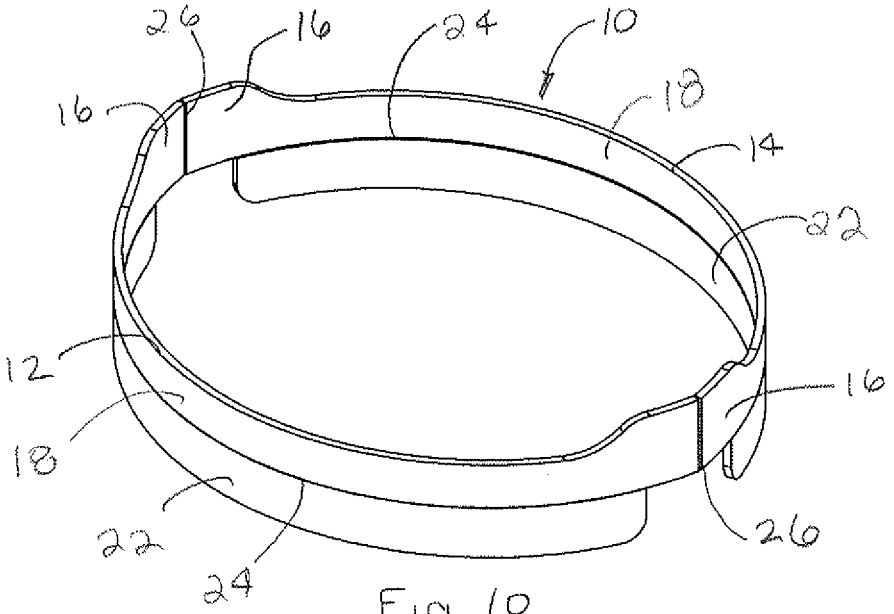
FIG. 10 is an isometric view of the hold open mechanism in an open configuration having first and second members having a single, continuous mounting tab in accordance with one embodiment.
Figure 11:
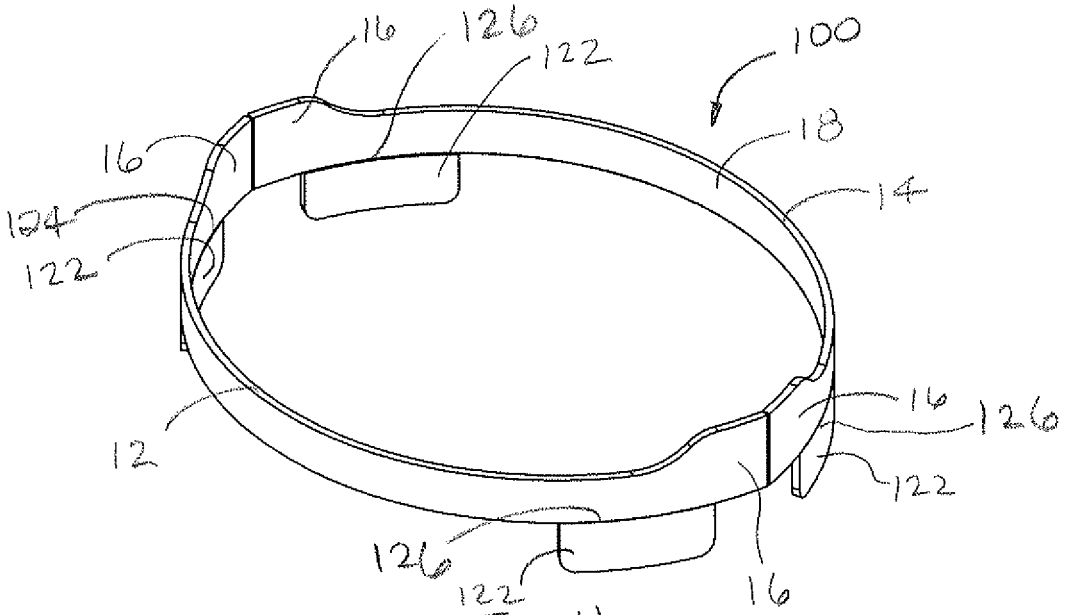
FIG. 11 is an isometric view of the hold open mechanism in an open configuration having first and second members having multiple, separated mounting tabs in accordance with one embodiment.

FIG. 10 is an isometric view of the hold open mechanism 10 similar in an open configuration having first and second members and a single, continuous mounting tab similar to that of FIG. 1. FIG. 11 is an isometric view of a hold open mechanism (used in a fitment process for example) and generally designated 100 in an open configuration in accordance with one embodiment. As illustrated in FIG. 11, mechanism 100 includes a first member 12 and second member 14. In at least one embodiment, at least one or both of the first and second flat, strip-like members 12, 14 are flexible or semi-rigid material such as polypropylene, polyethylene, a blend of polypropylene and polyethylene and the like. Each of the first and second members 12, 14 having wide sections 16 located at opposing ends of the first and second members 12, 14 and a narrow section 18 having a width less than the wide sections 18 and extending between and connecting the wide sections 16. Each of the first and second members 12, 14 has an edge 20.

FIG. 11 further illustrates a plurality of mounting tabs 122, extending along at least a portion of the edge 20 having an orientation parallel with the length of the first and second, flat, strips like members 12, 14. At least one mounting tab 122 are connected to the first and second, flat, strip like members 12, 14 via first pivot members 126, enabling the first and second, flat strip like member 12, 14 to pivot between a first upwards configuration to a second downwards configuration. FIG. 11 depicts the first and second, flat strip like member 12, 14 in an upwards position.

Figure 12A:
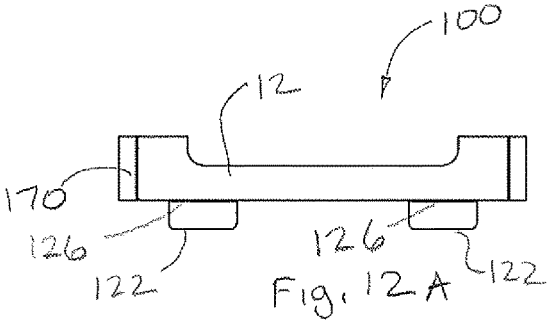
FIG. 12A is a side view of the hold open mechanism in an upwards configuration (used in a tape feed manufacturing process for example) in accordance with another embodiment.
Figure 12B:
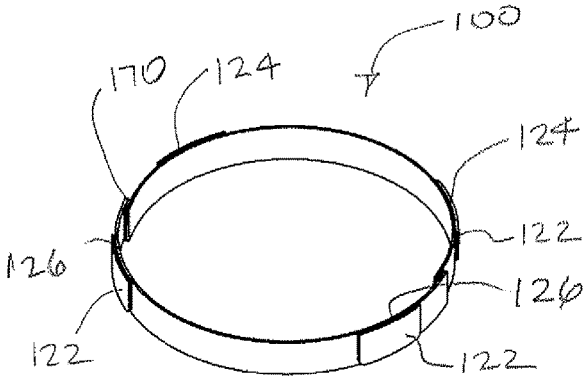
FIG. 12B is a side view of the hold open mechanism of FIG. 12A in a downwards configuration in accordance with one embodiment.
Figure 12C:
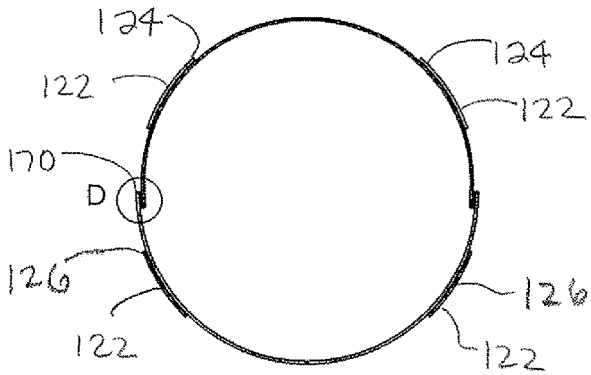
FIG. 12C is a top view of the hold open mechanism of FIG. 12A in an open configuration in accordance with one embodiment.
Figure 12D:
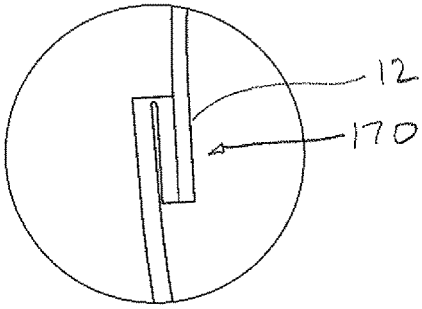
FIG. 12D is an enlarged view of detail D of FIG. 12C in accordance with one embodiment.

FIG. 12A is a side view of the hold open mechanism 100 of FIG. 11 in an open configuration (used in a tape feed for example) in accordance with another embodiment. FIG. 12A further illustrates first bonding tab 170 which bonds or join the first and second, flat strip like member 12, 14 used in a tape feed process for example. FIG. 12B is a side view of the hold open mechanism 100 of FIG. 12A in an open configuration in accordance with one embodiment. FIG. 12B depicts the first and second, flat strip like member 12, 14 in a downwards configuration. FIG. 12C is a top view of the hold open mechanism 100 of FIG. 12A in an open configuration in accordance with one embodiment. FIG. 12D is an enlarged view of detail D of FIG. 12C in accordance with one embodiment. FIG. 12D illustrates the first bonding tab 170 of the first member 12 interferes with side section of first member 12 in the downwards configuration.

Figure 13A:
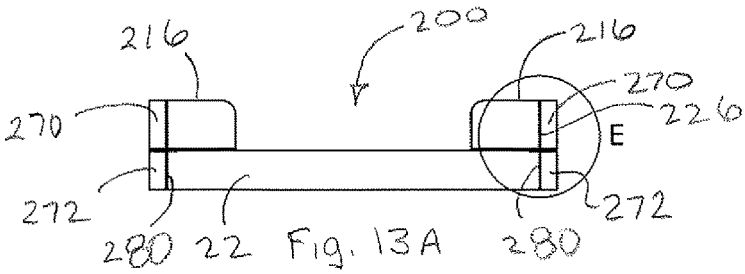
FIG. 13A is a side view of a hold open mechanism without narrow sections and continuous mounting tab in accordance with another embodiment.
Figure 13B:
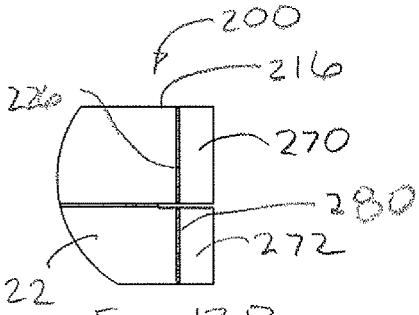
FIG. 13B is an enlarged view of detail E of FIG. 13A in accordance with another embodiment.

FIG. 13A is a side view of a hold open mechanism 200 in accordance with another embodiment. In the illustrated embodiment, hold open mechanism does not have narrow sections as provided above. Hold open mechanism 200 includes wide sections 216, continuous mounting tab 22 and first bonding tab 270 and second bonding tab 272, where the first and second bonding tab 270 are moveably connected to wide sections 216 via second pivot members 226 and the second bonding tab 272 is connected to the mounting tab 22 via third pivot members 280, where the third pivot members 280 having an orientation perpendicular or angled inwards relative to one of the first pivot member 24, FIG. 13B is an enlarged view of detail E of FIG. 13A illustrating the first bonding tab 270, second bonding tab 272, second pivot member 226 and third pivot member 280.

Figure 14A:
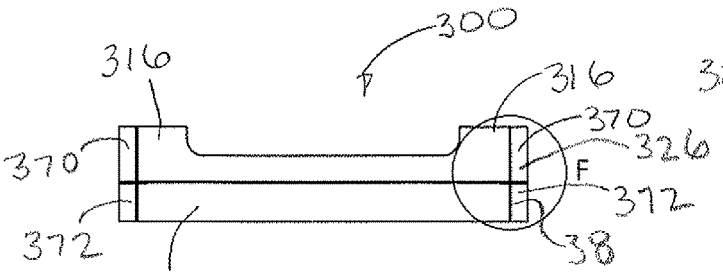
FIG. 14A is a side view of a hold open mechanism with narrow sections and continuous mounting tab in accordance with another embodiment.
Figure 14B:
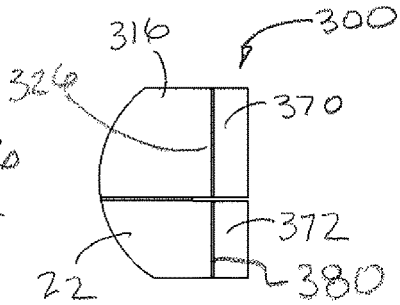
FIG. 14B is an enlarged view of detail F of FIG. 14 A in accordance with another embodiment.

FIG. 14A is a side view of a hold open mechanism 300 in accordance with another embodiment. In the illustrated embodiment, hold open mechanism does not have narrow sections as provided above. Hold open mechanism 300 includes wide sections 316, continuous mounting tab 22 and first bonding tab 370 and second bonding tab 372, where the first and second bonding tabs 370 are moveably connected to wide sections 316 via second pivot members 316 and the second bonding tab 372 is connected to the mounting tab 22 via third pivot members 380, where the third pivot members 380 having an orientation perpendicular or angled inwards relative to one of the first pivot member 24, FIG. 14B is an enlarged view of detail F of FIG. 14A illustrating the first bonding tab 370, second bonding tab 372, second pivot member 226 and third pivot member 280.

Figure 15A:
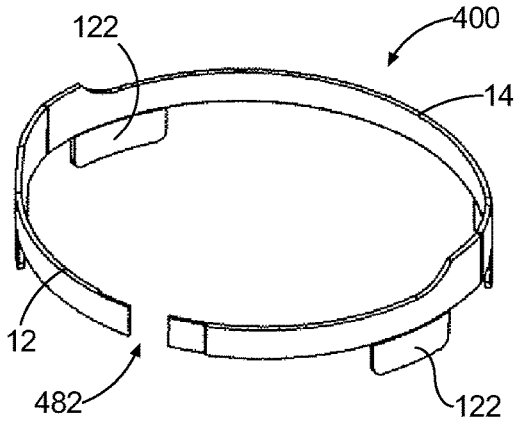
FIG. 15A illustrates a hold open mechanism fitment style manufacturing method depicting an isometric view of an unbounded hold open mechanism in accordance with one embodiment.
Figure 15B:
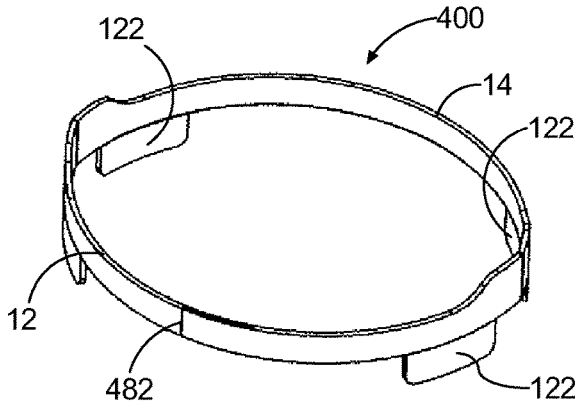
FIG. 15B illustrates a hold open mechanism fitment style manufacturing method depicting an isometric view of a bonded hold open mechanism in accordance with one embodiment.

FIG. 15A illustrates a hold open mechanism 400 used with a fitment style manufacturing method for example. FIG. 15A depicts an isometric view of an unbounded hold open mechanism 400 having a bonding location 482 in accordance with one embodiment. FIG. 15B illustrates the hold open mechanism bonded using bonded location 482.

One embodiment relates to a method of using the hold open mechanism 10 similar to that of any of the embodiments provided above. The method includes opening the hold open mechanism. Opening the hold open mechanism includes starting from a closed configuration where first and second flat, strip-like members are mated allowing the closure mechanism to maintain a closed position. The method further includes disengaging a closure mechanism (a zip type mechanism of example) located proximate the hold open mechanism so as to release a seal thus opening a package and separating the side walls of the package. The side walls of the package are further separated by applying an inwards pressure relative to the opening of the hold open mechanism at opposing ends of the hold open mechanism, thus moving the hold open mechanism from a first closed configuration to a second open configuration. The method includes applying an inwards and downwards pressure to a first and second flat, strip-like members thus rotating the first and second flat, strip-like members about respective first pivot members. The first and second flat, strip-like members are moved from a first upwards configuration to a second downwards configuration. The method includes maintaining an open and separated position of the first flat, strip-like member maintaining an open and separated position relative to the second flat, strip-like member thus allowing for easy access to contents of the container.

Closing the hold open mechanism 10 includes moving the first and second, flat strip like members in a separated and downwards configuration. An inwards and upwards pressure is applied to the first and second flat, strip-like members thus rotating the first and second flat, strip-like members about respective pivot members. The first and second flat, strip-like members are returned to a first, upwards configuration and having the ability to rotate freely about respective second pivot members and mate to one another allowing the closure mechanism to be engaged. The closure mechanism located proximate the hold open mechanism is engaged to close the seal thus preserving the withheld contents.

Figure 16:
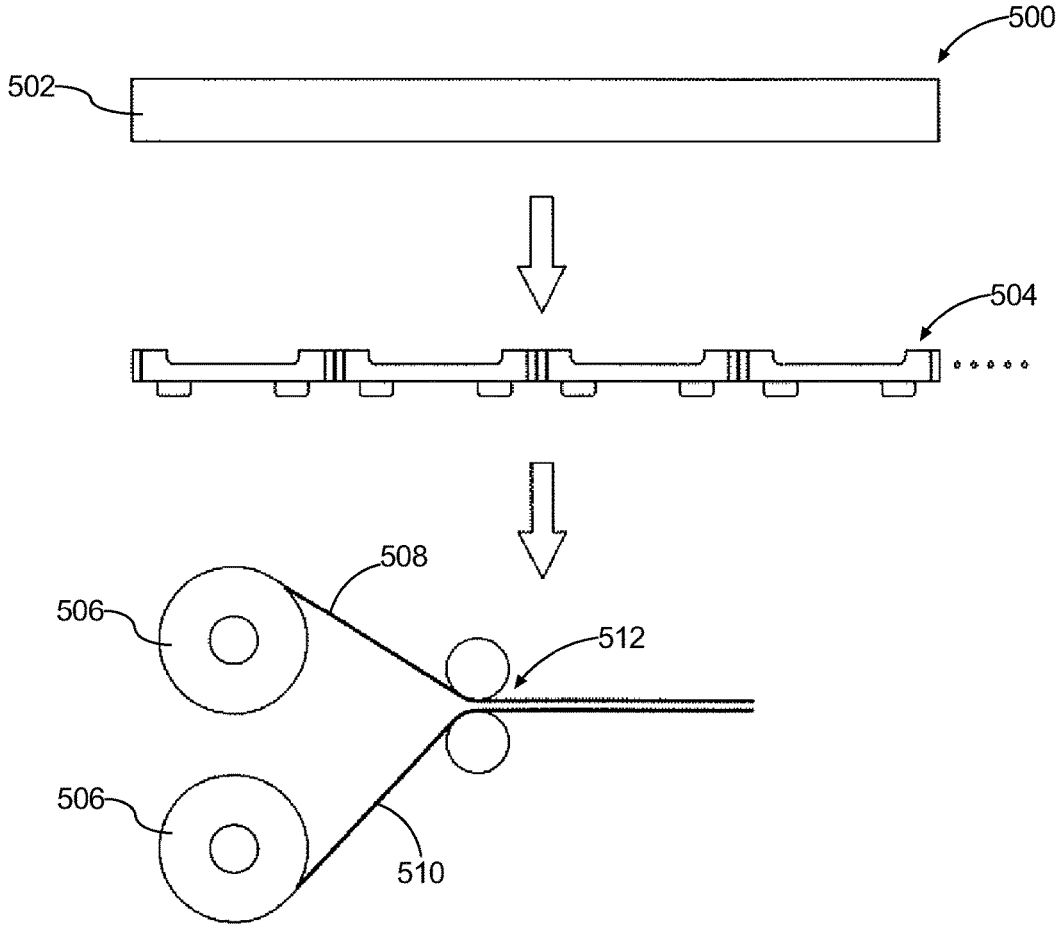
FIG. 16 illustrates a hold open mechanism tape feed variation manufacturing method in accordance with another embodiment.

FIG. 16 illustrates a hold open mechanism tape feed variation manufacturing method 500 in accordance with another embodiment. The embodiment starts as tape extrusion 502. The mechanism shape is cut and living hinges are scored into the tape using rotary die cutting process 504. The cut tape is mounted on bobbins 506 such that the first member tape 508 is mounted to one bobbin and the second member tape 510 is mounted to a second bobbin. The tape is fed to a heat sealing press 512 where bonding tabs are bonded forming complete hold open mechanisms. The mechanisms are feed into a mechanism (a horizontal for-fill-seal (HFFS) or a vertical for-fill-seal (VFFS) for example).

Figure 17:
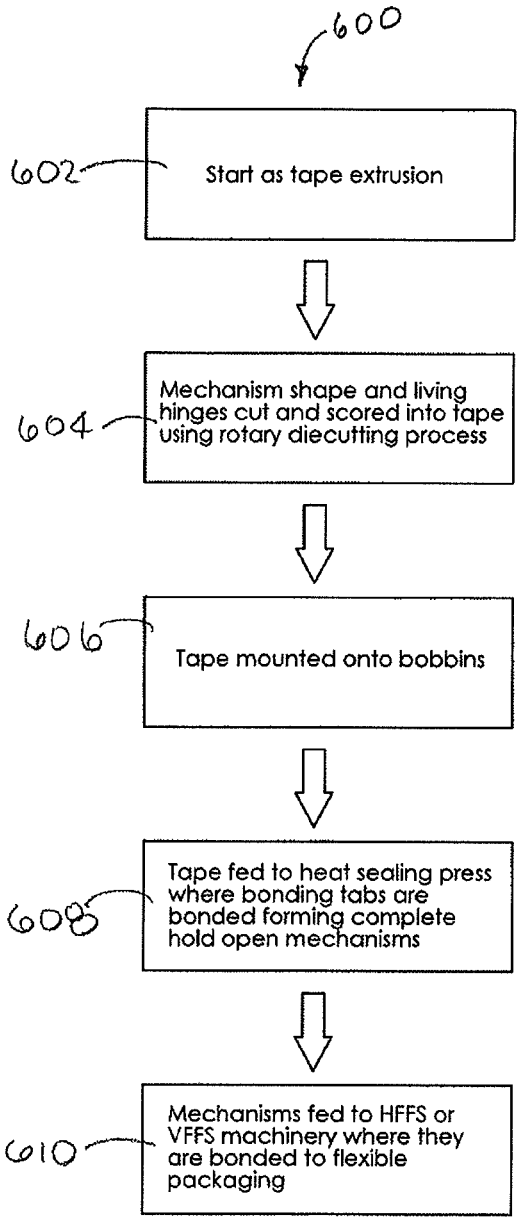
FIG. 17 is a flow chart illustrating a hold open mechanism tape feed variation manufacturing method in accordance with another embodiment.

FIG. 17 is a flow chart illustrating a hold open mechanism tape feed variation manufacturing method 600 in accordance with another embodiment. The method includes stating as a tape extrusion 602. The mechanism shape and the living hinges are cut and scored in the tape using rotary die cutting process 604. The cut tape is mounted on bobbins 606. The tape is fed to a heat sealing press where bonding tabs are bonded forming complete hold open mechanisms 608. The mechanisms are feed into machinery (a horizontal for-fill-seal (HFFS) or a vertical for-fill-seal (VFFS) for example) 610 where they are bonded to flexible packaging.

Figure 18:
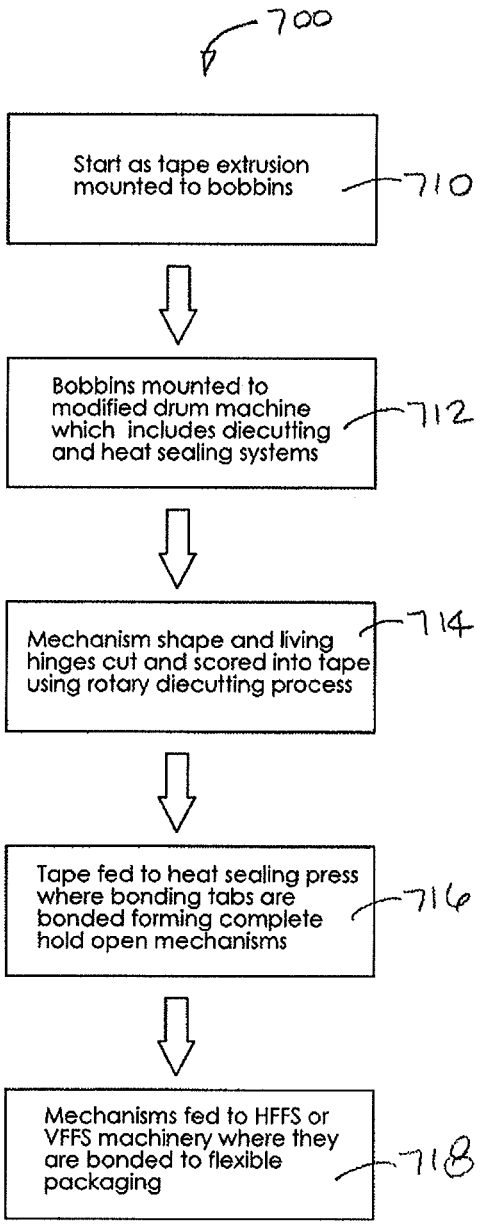
FIG. 18 is a flow chart illustrating another hold open mechanism tape feed variation manufacturing method in accordance with another embodiment.

FIG. 18 is a flow chart illustrating another hold open mechanism tape feed variation manufacturing method 700 in accordance with another embodiment. This embodiment starts as tape extrusion mounted to bobbins 710. The bobbins are mounted to modified drum machine which includes die cutting and heat sealing systems 712. The mechanism shape is cut and living hinges are scored into the tape using rotary die cutting process 714. The tape is feed to a heat sealing process where bonding tabs are bonded forming complete hold open mechanism 716. The mechanisms are feed into a mechanism (HFFS or a VFFS for example) where they are bonded to flexible packaging at any point along the manufacturing assembly process 718.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

I claim:

1. A hold open mechanism, comprising:

a first flexible portion having two opposing ends;

a second flexible portion having two opposing ends, the first portion being joined at its ends to respective ends of the second portion;

wherein the first flexible portion and the second flexible portion each include wide sections at their opposing ends and a narrow section having a width less than the wide sections and extending between and connecting the wide sections; and a first pivot member in the form of a vertical living hinge disposed at each of the joints between the first portion and the second portion and positioned at each side edge of the mechanism, such that the first portion is pivotable relative to the second portion about an axis of the first pivot member, wherein a first position, the first portion is substantially parallel with and coincident to the second portion, and in a second position, the first portion and the second portion define a substantially circular opening, a first mounting tab extending along an edge of the first portion and configured to secure the first portion to an internal surface of a container along an internal surface of the container sidewalls; and a second mounting tab extending along an edge of the second portion and configured to secure the second portion to an opening of the container along an internal surface of the container sidewalls, two gaps located between the ends of the first mounting tab and the ends of the second mounting tab and located below each of the first pivot members so that the first mounting tab and the second mounting tab straddle each of the side edges of the container, and a second pivot member in the form of a horizontal living hinge disposed between the edge of the first portion and the first mounting tab and additionally disposed between the edge of the second portion and the second mounting tab, wherein the first portion and the second portion rotate inwardly and downwardly about the second pivot member by applying an inwards and downward pressure to the first portion and the second portion to move the hold open mechanism from the first position to the second position to maintain the container in an open position, wherein in the second position the first portion and the second portion are folded inside the opening of the container and wherein the wide sections of the first flexible portion and the second flexible portion are adjacent to the gaps between the first mounting tab and the second mounting tab in the second position, and wherein the first pivot member is substantially perpendicular to the second pivot member, wherein the first pivot member is positioned at each side edge of the container, and wherein the vertical living hinge comprises a thinned or cut-out portion on the outside surface of the junction of the respective ends of the first flexible portion and the second flexible portion.

2. The hold open mechanism of claim 1, wherein the first portion and the second portion are substantially flat and a have a strip shape.

3. The hold open mechanism of claim 1, wherein at least one of the first and second portions is made of polypropylene or polyethylene.

4. The hold open mechanism of claim 1, wherein an indentation separation is located on an outer surface of the hold open mechanism in the first position.

5. The hold open mechanism of claim 1, wherein each of the first portion and the second portion includes first and second sections respectively located at the ends and a third section extending between and coupling the first and second sections, the third section being narrower than the first and second sections.

6. The hold open mechanism of claim 5, wherein in the second position, the third section of the first portion is spaced from the third section of the second portion.

7. The hold open mechanism of claim 1, wherein the first pivot member includes indentation walls limiting the rotation of the first portion and the second portion so that adjacent ends of the first portion and the second portion cannot rotate past 180 degrees of separation when the first portion and the second portion are in the first position.

8. The hold open mechanism of claim 1, wherein in the second position, the first portion and the first mounting tab are substantially parallel and coincident, and the second portion and the second mounting tab are substantially parallel and coincident.

9. The hold open mechanism of claim 1, wherein the container is a flexible bag.

10. The hold open mechanism of claim 1, further comprising a first bonding tab coupled to the first or second portion and including an area for bonding the first portion to the second portion.

11. The hold open mechanism of claim 10, further comprising a second bonding tab disposed adjacent to at least one of the first mounting tab and the second mounting tab and including an area for bonding the second bonding tab of the first portion to the second mounting tab or including an area for bonding the second bonding tab of the second portion to the first mounting tab.

12. The hold open mechanism of claim 11, wherein the first bonding tab and the second bonding tab are separated by a slit.

13. The hold open mechanism of claim 1, further comprising a third pivot member coupling the first mounting tab to the second mounting tab.

14. The hold open mechanism of claim 13, wherein the third pivot member is substantially perpendicular to the second pivot member.

15. The hold open mechanism of claim 1, wherein the first portion and second portion rotate inwardly and upwardly about the second pivot member by applying an inwards and upward pressure to the first portion and the second portion to move the hold open mechanism from the second position to the first position to maintain the container in a closed position, wherein in the first position the first portion and the second portion are in an upwards configuration above the opening of the container and wherein the wide sections of the first flexible portion and the second flexible portion are located above the two gaps between the first mounting tab and the second mounting tab in the first position.

* * * * *